US010227164B2

(12) United States Patent
Courtin

(10) Patent No.: US 10,227,164 B2
(45) Date of Patent: Mar. 12, 2019

(54) RIGID SHELL FOR A COMPRESSIBLE TUBE

(71) Applicant: Karine Courtin, Boulogne-Billancourt (FR)

(72) Inventor: Karine Courtin, Boulogne-Billancourt (FR)

(73) Assignee: Karine Courtin, Boulogne-Billancourt (FR)

( * ) Notice: Subject to any disclaimer, the term of this patent is extended or adjusted under 35 U.S.C. 154(b) by 0 days.

(21) Appl. No.: 15/540,814

(22) PCT Filed: Dec. 28, 2015

(86) PCT No.: PCT/EP2015/081276
§ 371 (c)(1),
(2) Date: Jun. 29, 2017

(87) PCT Pub. No.: WO2016/107839
PCT Pub. Date: Jul. 7, 2016

(65) Prior Publication Data

US 2018/0009575 A1 Jan. 11, 2018

(30) Foreign Application Priority Data

Dec. 31, 2014 (FR) ..... 14 63501

(51) Int. Cl.
*B65D 35/56* (2006.01)
*B65D 35/02* (2006.01)

(52) U.S. Cl.
CPC ..... *B65D 35/56* (2013.01); *B65D 35/02* (2013.01)

(58) Field of Classification Search
CPC ..... B65D 35/56; B65D 35/02
USPC ..... 222/105
See application file for complete search history.

(56) References Cited

U.S. PATENT DOCUMENTS 1,889,885 A 12/1932 Cullen
2,613,853 A 10/1952 Halvorsen
5,277,332 A 1/1994 Rogers
(Continued)

FOREIGN PATENT DOCUMENTS

FR 1 161 905 A 9/1958
JP WO 2012164779 A1 * 12/2012 ..... B65D 35/28
WO 92/08654 A1 5/1992

OTHER PUBLICATIONS

Search Report issued in French Patent Application No. 1463501 dated Oct. 14, 2015.
(Continued)

*Primary Examiner* — Donnell Long
(74) *Attorney, Agent, or Firm* — Pearne & Gordon LLP

(57) ABSTRACT

The invention relates to a rigid shell (10) for a flexible tube (12), which comprises: a body (20) having a longitudinal main orientation, which is made up of an upper wall (26), a lower wall (28) located opposite and separated from the upper longitudinal wall (26), and two side walls (30) connecting the upper wall (26) and the lower wall (28), a rigid head (22) located at a front longitudinal end of the body (20) which includes a central opening (32), the shell being made in a single piece from a rigid material, the rear longitudinal end of each side wall having a boss which projects towards the inside from the inner surface of the side wall.

9 Claims, 4 Drawing Sheets

(56) References Cited

U.S. PATENT DOCUMENTS

| | | | | |
|---|---|---|---|---|
| 5,346,108 | A * | 9/1994 | Pasinski | B65D 35/40 222/105 |
| 7,641,078 | B2 * | 1/2010 | Boumnso | B65D 83/0055 222/105 |
| 2016/0244223 | A1 | 8/2016 | Courtin | |

OTHER PUBLICATIONS

International Preliminary Report on Patentabiility issued in Patent Application No. PCT/EP2015/081276 dated Nov. 29, 2016.
International Search Report issued in Patent Application No. PCT/EP2015/081276 dated Feb. 18, 2016.
Written Opinion issued in Patent Application No. PCT/EP2015/081276 dated Feb. 18, 2016.

* cited by examiner

RIGID SHELL FOR A COMPRESSIBLE TUBE

TECHNICAL DOMAIN

The invention relates to a rigid shell designed to cover a tube containing a liquid or a paste product.

This tube is flexible and becomes gradually compressed as the product is distributed. The rigid shell thus keeps an essentially unchanging external appearance, and also protects the tube against accidental compression.

STATE OF PRIOR ART

The different types of receptacles containing cream or paste products include a receptacle in the form of a flexible tube, that is pressed to force its contents out.

Depending on the elasticity or lack of elasticity of its walls, this tube may tend to return to its initial shape after the pressure applied to it has been released. As a result, air is drawn into the tube to compensate for the volume of product that was drawn off.

Some tubes are fitted with non-return devices that automatically close off the distribution orifice to prevent air from penetrating inside the tube.

The tube also deforms progressively becoming crushed, as the product is drawn off.

These tube deformations adversely affect the general appearance of the tube.

Furthermore, deformation of the tube while its distribution end-piece is still closed, for example by a clip-on type cap on the end-piece, creates a high pressure inside the tube. The product can then escape through the distribution end-piece in an uncontrolled manner, which is unpleasant for the user.

Document U.S. Pat. No. 1,889,885 describes a rigid shell to protect a distribution tube for a product such as toothpaste.

This shell is composed of two plates between which the product tube is placed.

These two plates partly surround the distribution tube, to protect if from most of the loads that could be applied to it.

However, this shell does not entirely surround the distribution tube, such that it is easily visible from the outside and is not aesthetic.

Furthermore, the shell described in this document is made of two parts that are free to move relative to each other, so that the tube can be assembled between the two parts. The user might find it difficult to manipulate the two parts and their attachment means.

Moreover, the tube is only fixed to the shell at its end at which the distribution end-piece is located. Therefore, this reduces the stability of the tube in the shell and exposes it to external forces.

PRESENTATION OF THE INVENTION

The invention discloses a rigid shell for a flexible tube comprising a body having a longitudinal principal orientation, which is made up of an upper wall, a lower wall facing and at a distance from the longitudinal upper wall, and two lateral walls connecting the upper wall to the lower wall, a rigid head located at a front longitudinal end of the body that comprises a central orifice, characterised in that it is made of a single part from a rigid material.

Since the shell is made in a single part, it is easier to use because the user no longer has to manipulate different parts during assembly of the flexible tube.

Preferably, the back longitudinal end of each lateral wall comprises a boss projecting inwards from the internal face of said lateral wall.

Preferably, each boss comprises a groove open longitudinally forwards.

Preferably, the lower wall comprises a longitudinal opening that is open at the edge of the back end of the lower wall.

Preferably, said opening comprises a front edge located behind the front end edge of the lower wall.

Preferably, either one of both of the upper wall and the lower wall is approximately flat.

Preferably, either one of both of the upper wall and the lower wall is convex towards the outside of the shell.

Preferably, either one of both of the upper wall and the lower wall is in the shape of a trapezium, in which the parallel sides of the trapezium are formed from the edges of the front and back longitudinal ends of said upper wall or said lower wall.

The invention also discloses an assembly comprising a rigid shell according to the invention and a flexible tube inside the shell, said tube comprising a body made of a deformable material, a front end comprising a distribution orifice, and a closed back end, characterised in that the tube is held in position in the shell by an elastic engagement of the front end of the tube in the front end of the shell.

Preferably, the shape of the body of the shell is similar to the shape of the body of the tube.

BRIEF DESCRIPTION OF THE DRAWINGS

Other characteristics and advantages of the invention will become clear after reading the following detailed description that will be better understood by referring to the appended figures among which.

DETAILED PRESENTATION OF PARTICULAR EMBODIMENTS

Figure 1:
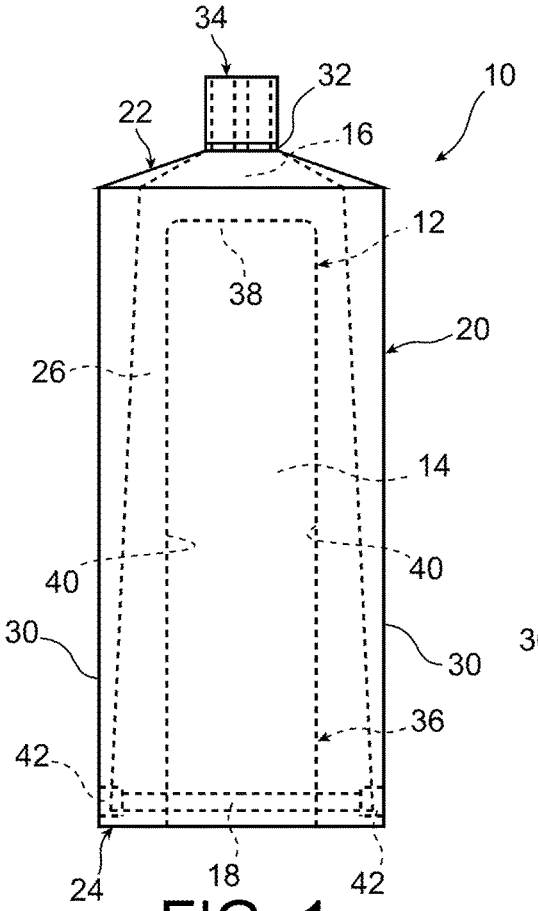
FIG. 1 is a diagrammatic top view of a shell according to the invention.

FIGS. 1 to 4 show a shell 10 containing a flexible tube 12.

The flexible tube 12 contains a paste or liquid product, for example such as a cosmetic cream.

The tube 12 comprises a body 14 made of a deformable material, a front end 16 comprising a distribution orifice, and a closed back end 18.

According to one example embodiment, the body 14 is obtained from a tubular cylinder that is closed at its back end by folding to form a straight edge making up the back end 18 of the tube 12.

It will be understood that the invention is not limited to such a flexible tube and that the shape and/or dimensions of the tube 12 can be different from what is shown on the figures.

For example, the body of the tube 12 may be in the form of a truncated cone, or convex.

The shape of the front end 16 of the tube 12 is similar to the shape of the main section of the cylinder from which the body 14 of the tube 12 is made. In this case, the shape of the front end 16 of the tube is circular, as can be seen particularly well on FIG. 4.

It will be understood that the invention is not limited to this shape, the front end 16 of the tube can also be oblong or oval, for example.

The shell 10 is designed to at least partly cover the tube 12.

The shell 10 comprises a body 20 that delimits a volume inside which the body 14 of the tube 12 fits, a front end 22 that cooperates with the front end 16 of the tube 12 and a back end 24 that cooperates with the back end 18 of the tube 12.

The shell 10 is preferably made of a single piece, for example made by moulding of plastic or any other material.

Thus, the body 20, the front end 22 and the back end 24 of the shell 10 are portions of the same part.

The front end 22 of the shell 10 has a shape associated with the shape of the front end 16 of the tube 12, and is preferably complementary to it.

In this case, the front end 16 of the tube 12 has a conical shape, and the front end 22 of the shell 10 also has a conical shape.

It comprises a central orifice 32 that will be passed through by a distribution end-piece 34 of the tube 12.

The body 20 surround the body 14 of the tube 12. It comprises an upper face 26 and a lower face 28, the upper face 26 and the lower face 28 are connected to each other by side walls 30. These four walls 26, 28, 30 of the body 20 are distributed around the body 14 of the tube 12.

The shape of each of the walls of the body 20 is defined such that the body 20 surrounds the body 14 of the tube 12 as much as possible.

Figure 2:
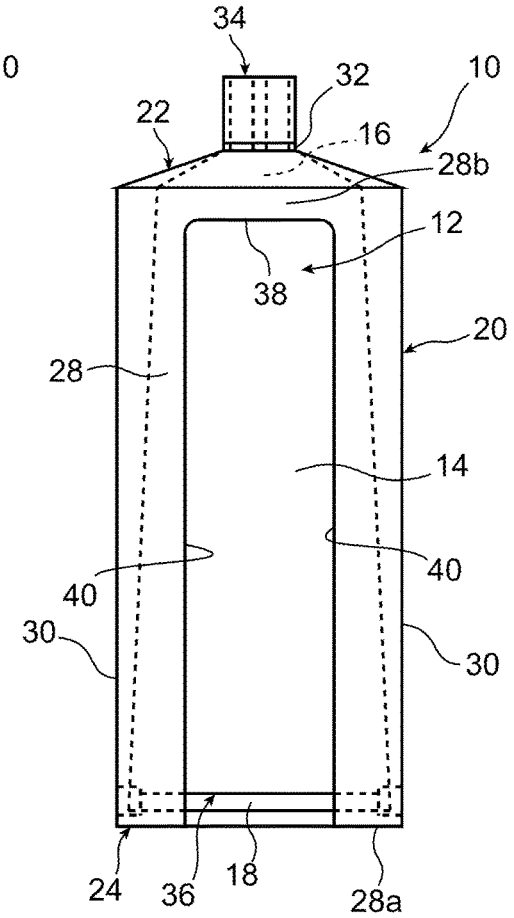
FIG. 2 is a bottom view of the shell shown in FIG. 1.
Figure 3:
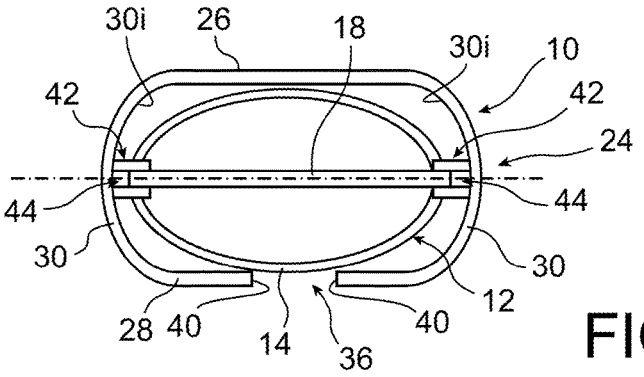
FIG. 3 is a view of the back end of the shell shown in FIG. 1.

In this case, as can be seen on FIGS. 1 to 3, there is a clearance between the body 14 of the tube 12 and the walls 26, 28, 30 of the body 20 of the shell 10. According to one variant embodiment, the body 14 of the tube 12 fits into the body 20 of the shell 10, with no gap when the tube 12 is full.

The material from which the shell 10 is made is a relatively rigid material, and in particular it is more rigid than the material from which the body 14 of the tube 12 is made.

Thus, when the tube 12 is inside the shell 10, it is protected from outside pressures that could accidentally expel the product.

This material can be transparent, so that a user can view inscriptions on the walls of the body 14 of the tube 12.

This material can also be opaque or translucent, that on the contrary hides inscriptions on the walls of the body 14 of the tube 12.

Inscriptions can also be arranged on the walls 26, 28, 30 of the body 20 of the shell 10, regardless of the material from which the shell is made, to replace or to complement the inscriptions on the tube 12.

As mentioned above, the body 20 of the shell 10 entirely surrounds the body 14 of the tube 12, protecting it from outside loads.

In order to enable the user to sollicitate the body 14 of the tube 12, to draw off a certain quantity of the product contained, the lower wall 28 of the shell 10 comprises an opening 36 through which, for example a finger of the user can pass, to press on the body 14 or the tube 12.

In this case, as can be seen on FIG. 2, the opening 36 extends along the longitudinal principal direction of the shell 10, starting from the back end 28*a* of the lower wall 28, at which the opening 36 opens up, until approximately the front end 28*b* of the lower wall 28.

The front edge 38 of the opening is thus located behind the front end 28*b* of the lower wall 28, at which the lower wall is connected to the front end 22 of the shell 10.

In this case the shape of the opening 36 is principally rectangular, in other words the opening comprises two longitudinal edges 40 at a distance from each other and a front edge 38. The opening 36 also opens up at its back end.

As a variant of the invention, the shape of the opening 36 is different, for example it may be oblong, with a front edge 38 shaped as the arc of a circle, or the opening 36 may be closed off at its back end that is consequently located at a distance from and in front of the back end 28*a* of the lower wall 28.

By using this opening 36, a user can, by pressing the body 14 of the tube 12 between his or her finger and the upper wall 26 of the shell, generate pressure on the product contained in the tube so that some of the product is expelled through the end piece 34.

The dimensions and the shape of the opening 36 are defined so that the user can press on the entire body 14 of the tube 12, so that it is possible to extract all the product contained inside the tube 12.

The shell 10 is open at its back end 24, so that the tube 12 can be inserted into the body 20 through this back end 24 along a longitudinal principal translation movement.

The back end 24 of the shell 10 also comprises retention means for retaining the tube 12 in the shell 10. These retention means in this case consist of two bosses 42, each of which is supported by the back longitudinal end of the internal face of a side wall 30.

Each boss 42 projects inwards from the associated internal face 30*i* to form a stop element against which the back end 18 of the tube 12 is stopped in the backwards longitudinal direction when the tube 12 is in position inside the shell 10.

The installation of the tube 12 in the shell 10 is performed by progressively inserting the tube 12 into the shell 10 through the opening in the back end.

The tube 12 was previously moved from its final position in the shell 10, so that insertion is not hindered by the bosses 42 and so that the tube is not deformed by contact with the bosses 42. This displacement is made either by rotating the tube 12 around its longitudinal principal axis, or by shifting the tube slightly downwards or upwards from its final position, to be offset from the bosses 42.

The dimensions of the body 20 of the shell 10 are defined so that the tube 12 can be inserted in the shell 10. Depending on the dimensions and the general shape of the tube 12, the tube 12 can then fit in the shell 10 with a given functional clearance.

However, the dimensions of the body of the shell 10 are also defined to prevent the tube 12 from coming out of the shell 10 due to the presence of these clearances between the tube 12 and the faces of the shell 20.

Figure 8:
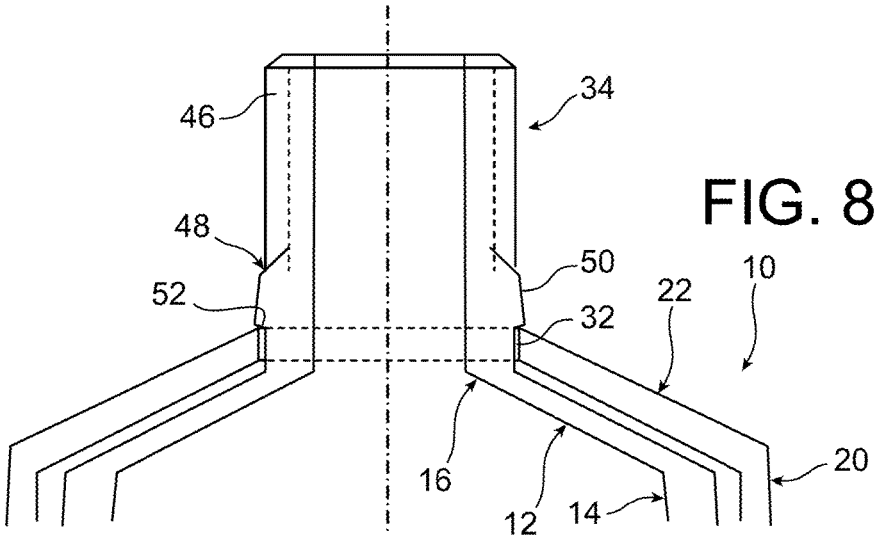
FIG. 8 is a larger scale detail of the front end of the body and the tube, showing means of solidarisation by clip fitting.
Figure 9:
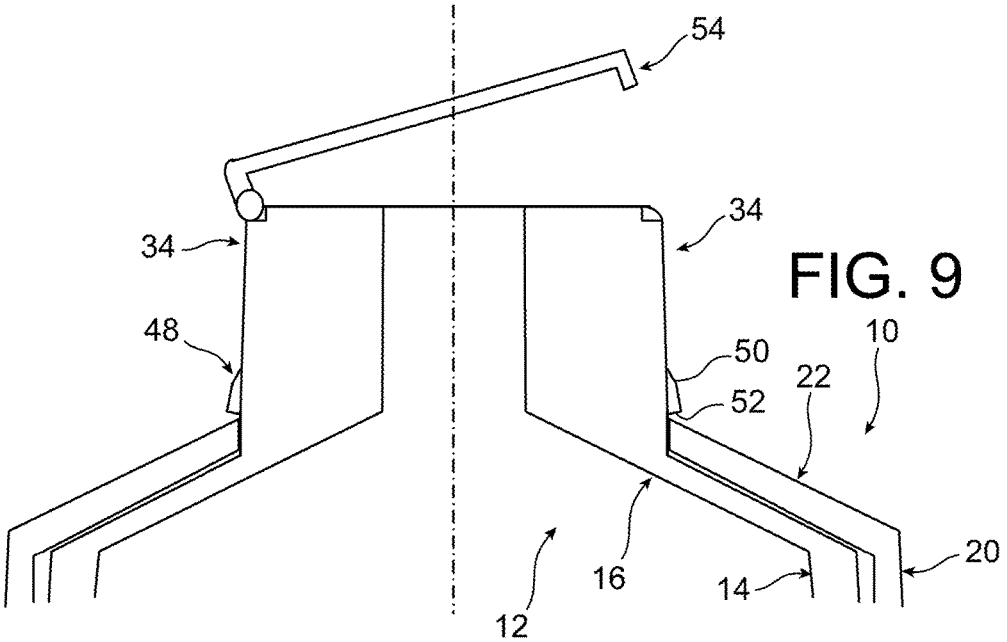
FIG. 9 is a view similar to the view shown in FIG. 8, in which the tube distribution orifice is closed off by a moving cover.

As can be seen on FIGS. 8 and 9, the tube 12 is held in position in the shell by an elastic engagement of the front end 16 of the tube 12 in the front end 22 of the shell 10.

The elastic engagement is preferably made at the base of the end piece 34 of the tube 12 that is engaged in the central orifice 32 of the front end 22, after the end-piece 34 has entirely passed through the central orifice 32.

For example, as shown in FIG. 8, the end piece 34 of the tube 12 comprises an external thread 46 so that a cap (not shown) can be screwed to close the end piece 34, and the base of the end piece 34 that is located underneath this thread 46 comprises a collar 48 with a diameter larger than the thread external diameter. The diameter of the central orifice 32 is larger than the diameter of the thread 46 of the end piece 34 and is less than the outside diameter of the collar 48.

The collar 48 also comprises a conical front face 50 defined to facilitate elastic deformation of the front end 22 of the shell 10 at the central orifice 32, when the end piece is inserted through the central orifice.

The collar 48 also comprises a conical back face 52 that bears in contact with the edge of the central orifice 32 when the end-piece 34 is fully inserted.

The opening angle of the front face 50 is very much less than the opening angle of the back face 52, so that the bearing of the back face makes it possible to put the end-piece 34 into place in the central orifice 32.

In the embodiment shown in FIG. 9, the end-piece comprises a cover 54 that is articulated to the end piece 34 and that closes it.

The external wall of the end-piece 34 is smooth and comprises only a collar 48 similar to that described above, comprising a conical front face 50 and a conical back face that bears in contact with the edge of the central orifice 32.

These two conical faces cooperate with the edge of the central orifice 32 as described above.

It will be understood that the invention is not limited to this method of retention by elastic engagement means, and that the retention means can be placed in another position in the shell, for example at the back edge of the front end 22 of the shell 10.

In order to complement the retention means by elastic engagement for the longitudinal retention of the tube inside the shell 10, each boss 42 comprises a groove 44, opening up longitudinally towards the front.

The two grooves 44 of the bosses 42 are designed to hold the flattened back end 18 of the tube 12.

The grooves 44 of the bosses 42 provide at the same time a longitudinal retention for the back end 18 of the tube 12 and retention against upwards or downwards vertical displacement of the back end 18 of the tube 12.

Figure 5:
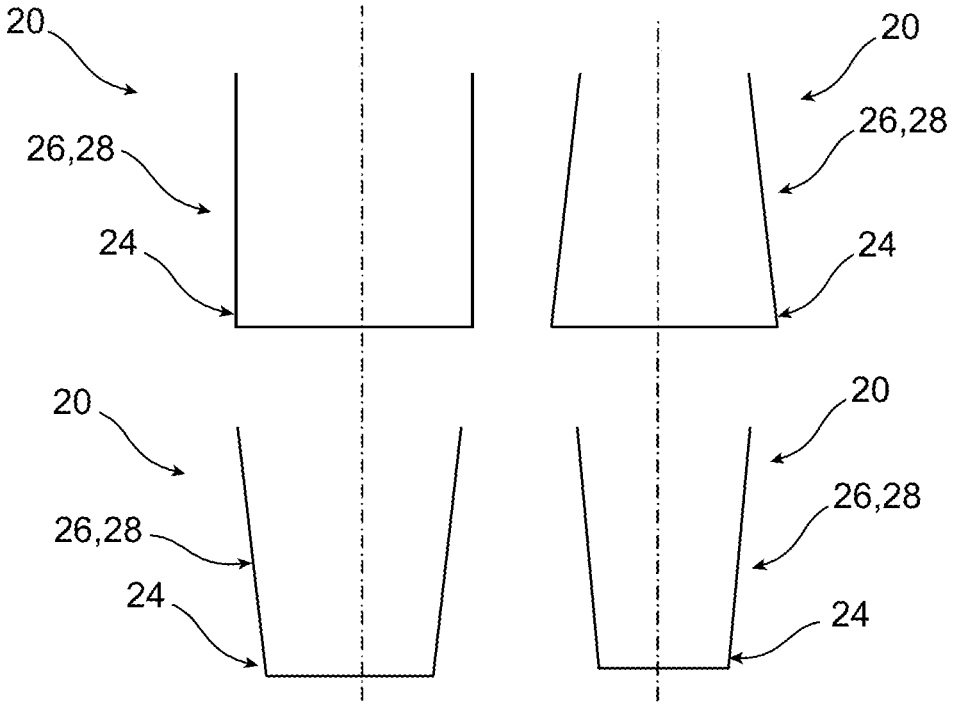
FIG. 5 shows different shapes of the top face or the bottom face of the shell shown in FIGS. 1 and 2.

FIG. 5 shows different methods of making the shapes of the upper 26 and lower 28 walls. Preferably, the shape and the dimensions of these walls are identical and are defined as a function of the shape of the tube 12 that will be located inside the shell 10.

According to a first embodiment, the two walls 26, 28 are rectangular in shape, like the embodiment in FIGS. 1 and 2.

According to one variant, the two walls 26, 28 have the shape of an isosceles triangle, for which the parallel sides or bases are formed by front end and back end of the walls 26, 28. The large base of this trapezium is thus located at the front end or the back end of each wall 26, 28.

Furthermore, according to one embodiment, one and/or both of the two walls 26, 28 is approximately flat.

According to one variant embodiment, one and/or both of the two walls 26, 28 is significantly curved and is convex towards the outside of the shell.

Figure 4:
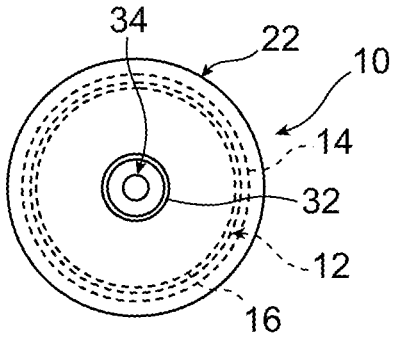
FIG. 4 is a view of the front end of the shell shown in FIG. 1.

According to the embodiment represented on FIG. 4, the front end 22 of the shell 10 is in the form of a cone of revolution, in other words its section in a plane perpendicular to the principal axis of the shell is circular.

Figure 6:
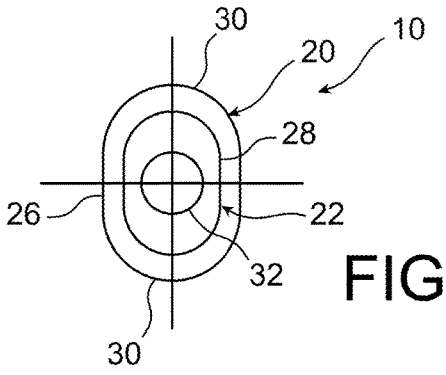
FIG. 6 shows an example shape of the front end of the shell shown in FIGS. 1 and 2.

According to one variant embodiment shown in FIG. 6, the section of the front end 22 of the shell 10 is oblong in shape, and the direction of the largest dimension of this section can be vertical or horizontal.

Finally, as shown on FIG. 3, the back end 24 of the shell 10 is oblong, and the large dimension is approximately equal to the width of the back end 18 of the tube 12.

Figure 7:
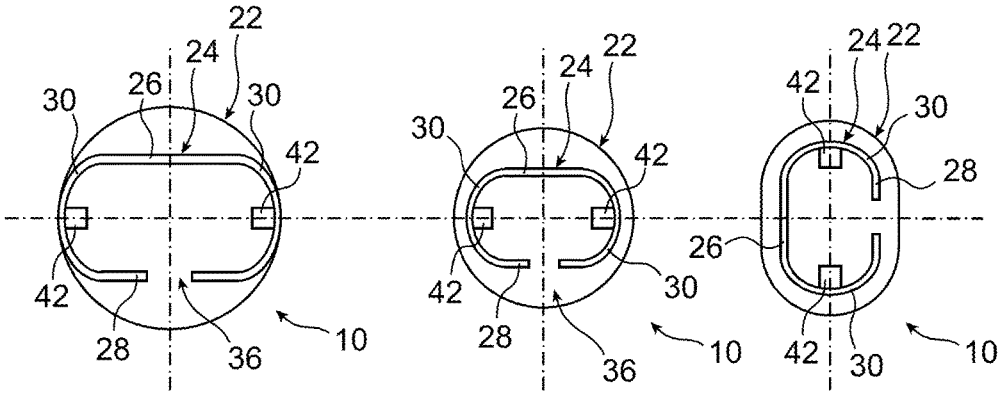
FIG. 7 shows different shapes of the back end of the shell shown in FIGS. 1 and 2.

This oblong shape of the back end 24 of the shell 10 is applicable to any shape and any size of the front end 22 of the shell 10, as shown in FIG. 7.

According to a first example, the large dimension of the back end 24 of the shell 10 is approximately equal to the diameter of the front end 22 of the shell 10 that is circular in shape.

According to a second example, the large dimension of the back end 24 of the shell 10 is less than the diameter of the front end 22 of the shell 10 that is circular in shape.

According to a third example, the front end 22 of the shell 10 is also oblong in shape, as shown in FIG. 6 and its large dimension is larger than the large dimension of the back end 24 of the shell 10.

What is claimed is:

1. A rigid shell for a flexible tube, comprising:

a body having a longitudinal principal orientation, which is made up of a longitudinal upper wall, a lower wall located facing and at a distance from the longitudinal upper wall, and two lateral walls connecting the upper wall to the lower wall; and a rigid head located at a front longitudinal end of the body that comprises a central orifice, the shell being made of a single part from a rigid material, and a back longitudinal end of each one of the two lateral walls comprises a boss projecting inwards from an internal face of said one of the two lateral walls in a direction towards the other one of the two lateral walls.

2. The rigid shell according to claim 1, wherein each boss comprises a groove open longitudinally forwards.

3. The rigid shell according to claim 1, wherein the lower wall comprises a longitudinal opening that is open at the edge of the back end of the lower wall.

4. The rigid shell according to claim 3, wherein said opening comprises a front edge located behind the front edge end of the lower wall.

5. The rigid shell according to claim 1, wherein either one or both of the upper wall and the lower wall, is approximately flat.

6. The rigid shell according to claim 1, wherein either one or both of the upper wall and the lower wall, is convex towards the outside of the shell.

7. The rigid shell according to claim 1, wherein either one or both of the upper wall and the lower wall, is in the shape of a trapezium, in which the parallel sides of the trapezium are formed from the edges of the front and back longitudinal ends of said upper wall or said lower wall.

8. An assembly comprising a rigid shell according to claim 1, and a flexible tube inside the shell, said tube comprising a body made of a deformable material, a front end comprising a distribution orifice, and a closed back end, wherein the tube is held in position in the shell by an elastic engagement of the front end of the tube in the front end of the shell.

9. The assembly according to claim 8, wherein the shape of the body of the shell is similar to the shape of the body of the tube.

* * * * *